United States Patent [19]

Bastenbeck

[11] Patent Number: 4,554,049

[45] Date of Patent: Nov. 19, 1985

[54] SELECTIVE NICKEL STRIPPING COMPOSITIONS AND METHOD OF STRIPPING

[75] Inventor: Edwin W. Bastenbeck, Plymouth, Conn.

[73] Assignee: Enthone, Incorporated, West Haven, Conn.

[21] Appl. No.: 618,159

[22] Filed: Jun. 7, 1984

[51] Int. Cl.[4] ..... C09K 13/04; C09K 13/06; C23F 1/00; C23G 1/08

[52] U.S. Cl. ..... 156/656; 134/3; 134/41; 156/664; 252/79.1; 252/79.2; 252/79.4; 252/100; 252/101; 252/102; 252/142; 252/148

[58] Field of Search ..... 134/3, 41; 252/79.1, 252/79.2, 79.4, 100, 101, 102, 142, 148; 156/654, 656, 664

[56] References Cited

U.S. PATENT DOCUMENTS

| | | | |
|---|---|---|---|
| 3,367,874 | 2/1968 | Haviland | 252/79.2 |
| 3,399,143 | 8/1968 | Slominski | 252/79.2 |
| 3,801,512 | 4/1974 | Solenberger | 252/186 |
| 3,856,694 | 12/1974 | Becking | 252/101 |
| 3,931,030 | 1/1976 | Ohno | 252/79.4 |
| 4,244,833 | 1/1981 | Tomaszewski | 252/101 |
| 4,302,246 | 11/1981 | Brindisi | 75/101 R |
| 4,459,216 | 7/1984 | Nakazato | 252/79.4 |

FOREIGN PATENT DOCUMENTS

| | | | |
|---|---|---|---|
| 49-23800 | 3/1974 | Japan | 252/79.2 |
| 55-18502 | 2/1980 | Japan | 156/664 |
| 57-82473 | 5/1982 | Japan | 252/79.2 |
| 57-98676 | 6/1982 | Japan | 252/79.2 |
| 58-174584 | 10/1983 | Japan | 252/79.2 |

*Primary Examiner*—Dennis L. Albrecht
*Attorney, Agent, or Firm*—John J. Tomaszewski; Kenneth A. Koch

[57] ABSTRACT

Stripping solutions comprising hydrogen peroxide and sulfamic acid in correlated amounts are effective for the rapid and selective removal of nickel from mild steel surfaces and nickel, nickel alloy and nickel reaction products from alloy substrates. The compositions contain sulfamate, nitrate and chloride and peroxide ions and, preferably, an iron complexing agent such as ethylene diamine tetraacetic acid.

16 Claims, No Drawings

SELECTIVE NICKEL STRIPPING COMPOSITIONS AND METHOD OF STRIPPING

BACKGROUND OF THE INVENTION

This invention is related to the stripping of nickel, nickel alloys and nickel reaction products from a variety of metal substrates, and, more particularly, to a novel stripping composition and accompanying method for the selective removal of these nickel coatings without damaging the underlying substrate.

Selective metal stripping is one of the most common steps in many industrial manufacturing processes. Usually, the stripping is part of either a general overhaul, involving the refurbishing of a particular coating, the reclaiming of a defectively plated part, or the recovery of the metal coating. The overhauling process becomes economically feasible when the specific product to be stripped is particularly valuable, such as in the case of high performance aircraft engine components. Also, defective plating will usually occur in a certain percentage of plated parts, resulting from imperfections in the basis metal, improper cleaning, excessive porosity of the substrate which leads to bleeding out of various cleaning and plating solutions, impurities, and human error.

One area of particular interest to industry is the selective stripping of electrolytic nickel and low phosphorous electroless nickel coatings from mild ferrous (e.g., steel) substrates. For this process it is necessary to strip substantially all, e.g., greater than 99%, of the coating because upon subsequent reprocessing lamination, blistering, skip plating, patterned appearance and dimensional changes may occur. Acidic strippers containing phosphoric acid are rapid and don't attack the steel substrate; however, during stripping, after about 95% of the nickel is removed, and electric potential is formed between the steel surface and the nickel remaining on the surface and the part becomes passive and stripping ceases. A two-step procedure is usually employed wherein after the phosphoric acid stripping, an alkaline stripper is used to strip the remaining nickel coating. The two-step procedure is inefficient and waste disposal problems are increased because of the alkaline stripper.

Another important industrial application is the selective stripping of reaction product coatings from nickel-base jet engine parts. These coatings are generally known as nickel sulfidation products and must be removed to enable inspection of the part.

The particular method of stripping will usually depend upon the metal (or metals) to be stripped, the substrate material of the basic part, waste disposal requirements and profitability. The prior art has employed a variety of both chemical and mechanical methods in an effort to selectively remove nickel and nickel compound coatings from the underlying metal substrate, however, they have proven unsatisfactory for a variety of reasons. Damage to precision machined parts such as jet engine stator assemblies, particularly the large dimensional changes which can result on the metal substrate, as well as pit formation in the base metal caused by pinholes in the hard coating are frequent results of using pressure blasting, abrasive tool methods and electrolytic stripping.

Low metal stripping rates, general ineffectiveness at low operating temperatures, the handling and disposal of toxic cyanide containing solutions, and the environmental disposal of the spent fluids are problems arising from known chemical methods. For example, U.S. Pat. No. 3,365,401 discloses a bath for stripping nickel from base metal objects comprising an aqueous solution of a nitro-substituted mononuclear carbocyclic aromatic compound, a complexing agent for nickel ions, ammonium ions to maintain the pH above about 6.8 and a sulfur compound yielding in the aqueous solution sulfur ions in a −2 oxidation state. Another nickel chemical stripper is shown in U.S. Pat. No. 3,717,520 and is an alkaline solution comprising a nitro-substituted aromatic compound, elemental sulfur, alkali phosphate, alkali chloride, alkylene polyamine and a corrosion attack inhibitor such as an alkali metal nitrite. Hydrogen peroxide-sulfuric acid mixtures are disclosed in U.S. Pat. Nos. 3,293,093; 4,130,455 and 4,174,253 for the etching of copper on printed circuit boards. The use of sulfuric acid in combination with hydrogen peroxide proved unacceptable for stripping nickel from mild steel as shown in the examples.

Accordingly, it is an object of this invention to formulate an effective composition and accompanying method for the selective stripping of nickel and nickel compound coatings from metal substrates.

Another object of the invention is to provide an effective stripping composition which may be easily and safely treated for waste disposal.

SUMMARY OF THE INVENTION

It has now been discovered that nickel and nickel compounds such as electrolyic nickel, low phosphorous electroless nickel, e.g., less than 7% phosphorus and nickel sulfidation products, may be selectively substantially stripped from metal substrates, e.g., ferrous metal substrates, by employing an acidic solution comprising effective amounts of sulfamate, nitrate, chloride and peroxide ions. A preferred embodiment also includes a complexing agent such as ethylene diamine tetraacetic acid.

Broadly stated, in grams/liter, the solution contains about 25 to saturation sulfamate ions (calculated as $OSO_2NH_2$), about 1 to 25 nitrate ions, about 0.1 to 8 chloride ions, about 30 to 250 hydrogen peroxide and, optimally, about 2 to 60 complexing agent.

The method of the present invention involves:

(a) contacting the deposit on the substrate with the acidic solution of the invention; and (b) continuing the contacting until the deposit is selectively removed, e.g., dissolved, from the substrate surface.

It is important in practicing the method of the invention that the levels of the ingredients be maintained within the proper concentrations or the nickel coating will not be completely stripped and low stripping rates will be obtained. Additionally, if the peroxide concentration falls below the lower limit, substantial degradation of the substrate will occor. Ordinarily, under normal conditions, only the peroxide component need be monitored through the life of the solution.

In preparing the stripper solutions, the ingredients may be admixed together with water. It is preferable, however, to prepare three concentrates which may be added to the water in certain proportions. The first concentrate preferably contains the sulfamate component; the second concentrate contains the hydrogen peroxide component; and the third concentrate contains the nitrate, chloride and complexing agent components.

DESCRIPTION OF THE PREFERRED EMBODIMENTS

The sulfamate ions are supplied in the stripping solutions of this invention by any suitable source of sulfamate ion. Exemplary of the sulfamate ion source is sulfamic acid, ammonium sulfamate, and an alkali metal sulfamate, e.g. sodium or potassium sulfamate. Sulfamic acid is a preferred source of the ion. The sulfamate ions (calculated as $OSO_2NH_2$) are present in the stripping solution in an effective amount, generally, in grams/liter, about 25 to saturation, preferably about 45 to 90, and most preferably about 55 to 75.

The nitrate and chloride ions are provided by any source such as acids and salts. Salts are preferred, particularly, inorganic salts having cations such as alkali metal, nickel, calcium, magnesium, or combinations thereof. Particularly preferred because of its demonstrated effectiveness are ammonium chloride and ammonium nitrate. The nitrate ions are generally present, in grams/liter, about 1 to 25, preferably about 3 to 17, and most preferably about 7 to 15. The chloride ions are generally present, in grams/liter, about 0.1 to 8, preferably about 0.5 to 4 and most preferably about 1 to 3.

The greatly preferred peroxide agent of choice is hydrogen peroxide, $H_2O_2$, from the perspective of performance, cost, availability and environmental effect. An amount of $H_2O_2$, in grams/liter, of about 30 to 250, or higher, may be employed, with a preferred range being about 75 or 100 to 150. Other peroxides as well as other peroxide agents, e.g., perborates, peroxydiphosphates, peroxysulfates and the like may also be employed. It is important as shown in the examples that the peroxide component be maintained above about 30 g/l, preferably 50 g/l, or the stripping action of the solution becomes very agressive and attacks the substrate. Preferred hydrogen peroxides are Albone M and Tysul WW sold by DuPont. Fifty percent (50L %) volume hydrogen peroxide solutions are preferred although other concentrations may suitably be employed.

A chelating agent is preferably employed in the composition to, for example, complex any iron present, thereby minimizing decomposition of the peroxide component. Ethylene diamine tetraacetic acid (EDTA) is the preferred chelating agent because of its demonstrated effectiveness but other such agents may suitably be employed. An amount of EDTA, in grams/liter, of about 2 to 60, preferably about 2 to 6 is generally employed.

The balance of the composition is preferably water although other suitable solvents may be used.

As is known in the art, other additives such as surfactants, defoamers, etc. may be employed in the composition.

In accordance with the method of the present invention, a working solution is prepared and applied to the substrate in a manner which facilitates physical removal of the nickel coating from the ferrous metal substrate. Preferably, the substrate is contacted, e.g., immersed in, or sprayed with, a working solution of the invention at a temperature ranging between about 50° F. to 120° F., and, preferably, below about 90° F. or 100° F. A preferred operating range is between about 65° F. to 75° F. The stripping reaction is exothermic and cooling is usually necessary to maintain the desired temperature. Stripping times will vary depending upon the configuration of the substrate, thickness of the coating, concentration of the solution constituents, temperature and the type of agitation, if any, which is used. Generally, stripping will be completed in less than 1 hour, e.g., 10–30 minutes. In order to illustrate more fully the improved solutions and method of the invention, the following examples are set forth, but do not limit the scope of the invention.

EXAMPLE I

A stripping bath was prepared having the following composition.

| Solution (gram/liter) | |
|---|---|
| Component | Bath |
| Sulfamic Acid | 75 |
| $NO_3^-$ | 12 |
| $Cl^-$ | 1.5 |
| EDTA | 4 |
| $H_2O_2$ | 125 |
| $H_2O$ | Balance |

$NH_4NO_3$ and $NH_4CL$ were used as the source of the nitrate and chloride ions, respectively, and 50% by volume Albone M was used as the hydrogen peroxide source. The mild steel employed is Unified Numbering System G10400.

The bath was at room temperature and used to strip a mild steel article having a coating of electrolytic nickel. Essentially 100% of the nickel coating was removed within 15 minutes with no damage to the substrate material. During use the temperature of the bath tended to increase and it was controlled to maintain the temperature at about 90° F.

EXAMPLE II

The composition of EXAMPLE I was employed, except that the amount of $H_2O_2$ was varied as indicated, to contact mild steel plates (G10400) by immersion of the plates into the bath.

| g/l | pH | Weight Loss (milligrams) | Time (minutes) |
|---|---|---|---|
| 0 | 1.3 | 15.8 | 30 |
| 31 | 1.3 | 680.4 | 2 |
| 62 | 1.3 | 9.7 | 30 |
| 93 | 1.3 | 2.7 | 30 |
| 124 | 1.2 | 0 | 30 |
| 186 | 1.0 | 0.5 | 30 |

The above data clearly shows the need for maintaining the peroxide level above about 30 g/l to prevent attack on the mild steel plate.

Comparative tests on mild steel plates employing a solution of 60 g/l sulfamic acid and 0–124 g/l $H_2O_2$ showed the same critical level of about 30 g/l peroxide. The same tests performed using 60 g/l $H_2SO_4$ in place of sulfamic acid showed increasing attack on the mild steel as the peroxide was increased culminating in an explosive attack at about 90 g/l peroxide.

Although the preceding Examples are presented solely for purposes of illustration, it is to be understood that such solutions and methods for selectively stripping nickel and nickel compounds in accordance with the invention may be altered, varied or modified without departing from the spirit or scope of the invention as defined by the appended claims. The configuration shape or size of a component from which the nickel coatings can be removed in accordance with the invention is not limited. However, the configuration, shape or size of the substrate may effect the time or particular manner of application of the improved solutions of the invention, as will be readily apparent to one skilled in the art.

It has also been discovered that reaction product coatings developed on nickel-base jet engine parts during use may be selectively stripped using the compositions and methods of the invention as described hereinabove. Some of the nickel-base alloys which may be selectively stripped are sulfidation products, nickel aluminide, nickel graphite, nickel tungsten, cobalt tungsten, and the like.

I claim:

1. An aqueous solution for selectively stripping electrolytic nickel and low phosphorous electroless nickel from a ferrous metal substrate comprising, in grams/-liter:

(a) Sulfamate ions (calculated as $OSO_2NH_2$) in an amount about 25 to saturation;
(b) Nitrate ions in an amount about 1 to 25;
(c) Chloride ions in an amount about 0.1 to 8;
(d) Hydrogen peroxide in an amount about 30 to 250; and
(e) An iron complexing agent in an amount about 2 to 60.

2. The solution of claim 1 wherein the constituents are present in the following amounts, in grams/liter:

(a) Sulfamic acid in an amount about 45 to 90;
(b) Nitrate ions in an amount about 3 to 17;
(c) Chloride ions in an amount about 0.5 to 4;
(d) Hydrogen peroxide in an amount about 75 to 150; and
(e) An iron complexing agent in an amount about 2 to 60.

3. The solution of claim 2 wherein the constituents are present in the following amounts, in grams/liter;

(a) Sulfamic acid in an amount about 55 to 75;
(b) Nitrate ions in an amount about 7 to 15;
(c) Chloride ions in an amount about 1 to 3;
(d) Hydrogen peroxide in an amount about 100 to 150; and
(e) An iron complexing agent in an amount about 2 to 60.

4. The solution of claim 1 wherein the source of the sulfamate ions is sulfamic acid.

5. The solution of claim 4 wherein the source of the nitrate and chloride ions are the ammonium salts thereof.

6. The solution of claim 5 wherein the iron complexing agent is ethylene diamine tetraacetic acid.

7. The solution of claim 1 wherein the iron complexing agent is ethylene diamine tetraacetic acid.

8. A method for selectively stripping electrolytic nickel and low phosphorous electroless nickel from a ferrous metal substrate comprising:

(a) contacting the deposit on the ferrous metal substrate with the solution of claim 1; and
(b) continuing the contacting until the deposit is selectively removed from the substrate surface.

9. The method of claim 8 wherein the solution is the solution of claim 2.

10. The method of claim 8 wherein the solution is the solution of claim 6.

11. The method of claim 8 wherein the solution is at a temperature in the range of about 50° F. to about 120° F. during the contacting.

12. The method of claim 11 wherein the temperature range is below about 100° F.

13. A method for selectively stripping nickel sulfidation compounds from nickel-base alloy substrates comprising:

(a) contacting the deposit on the alloy substrate with the solution of claim 1; and
(b) continuing the contacting until the deposit is selectively removed from the substrate surface.

14. The method of claim 13 wherein the solution is the solution of claim 2.

15. The method of claim 13 wherein the solution is the solution of claim 6.

16. The method of claim 13 wherein the solution is at a temperature in the range of about 50° F. to about 120° F. during the contacting.

* * * * *